166-66 SR
4/9/85 XR 4,509,593

United States Patent [19]

Traver et al.

[11] Patent Number: 4,509,593

[45] Date of Patent: Apr. 9, 1985

[54] DOWNHOLE MOBILITY AND PROPULSION APPARATUS

[75] Inventors: Jack L. Traver; C. Dale Palmer, both of Lafayette; Richard Hughes, Youngsville, all of La.

[73] Assignee: Traver Tool Company, Lafayette, La.

[21] Appl. No.: 505,583

[22] Filed: Jun. 20, 1983

[51] Int. Cl.[3] ..... E21B 7/08

[52] U.S. Cl. ..... 166/63; 166/66; 166/104; 166/249; 175/73; 175/25

[58] Field of Search ..... 175/61, 213, 73, 231, 175/94, 25, 4.5, 26, 4.51, 218, 45; 166/64, 63, 66, 77, 249, 104; 181/113, 116, 117, 118, 121

[56] References Cited

U.S. PATENT DOCUMENTS

| | | | |
|---|---|---|---|
| 3,215,074 | 11/1965 | Robinson, Jr. et al. | 175/4.5 |
| 3,422,913 | 1/1969 | Young, Jr. | 175/213 |
| 3,620,313 | 11/1971 | Elmore et al. | 175/14 |
| 4,280,557 | 7/1981 | Bodine | 166/249 |

*Primary Examiner*—Stephen J. Novosad
*Assistant Examiner*—Mark J. DelSignore
*Attorney, Agent, or Firm*—Bode & Smith

[57] ABSTRACT

An apparatus which comprises an upper sub for connectable engagement with the wire line, a microprocessor component for directing the various functions of the overall apparatus down hole; a motor section having a plurality of thrust directional motors and ball screw assembly for movement of steering gates; a motor driven impellar means for providing thrust and flow through a portion of the apparatus and in combination with the flow gates providing steering in a certain direction; an electric transducer portion for providing ultrasonic vibrations around the circumference of the apparatus in discongealing molecular substrate adjacent the apparatus; a mechanical vibration coil assembly means on the lower end of the apparatus for discongealing larger areas of congealing in a substrate around the apparatus, and a lower sub for connectably engaging the electrical logging unit to be steered down hole. The apparatus may also comprise on either end a thrust explosive sub for explosively dislodging the apparatus in the event of lodging occuring down hole.

11 Claims, 14 Drawing Figures

DOWNHOLE MOBILITY AND PROPULSION APPARATUS

BACKGROUND OF THE INVENTION

1. Field of the Invention

This invention relates to steering tools. More particularly, the present invention relates to an apparatus for inducing and assisting an electrical tool or the like being lowered down and raised up an oil well bore hole. Even more particulary, the apparatus of the present invention would relate to a steering tool having a combination of directional impellar and thrusting mechanisms, sonic vibration means, and mechanical oscillator means for steering an electrical device down an oil well bore thus maintaining the device in proper postion within the hole enabling the electrical tool to move freely and more rapidly therein.

2. General Background

Due to the ever increasing need for oil, the result or one of the results has been the need to drill oil wells at greater depths in order to reach the oil. As can be expected, in these greater depths, deeper wells are encountering many hazardous drilling problems due mainly to the increased friction, temperatures and pressures which are directly proportional to the increased depth. In the art of drilling oil wells, for each foot that is drilled into the earth, there is an increased pressure of approximately ½ pound per square inch on the drilling apparatus. The result being that a zone encountered at a depth, for example, of 2 miles, will have a pressure of approximately 5,000 pounds per square inch. In order to maintain this pressure and prevent it from moving up the bore hole unchecked, which would result in a blow-out and loss of valuable rig time, not to mention perhaps injury to workers and loss of valuable equipment; drilling mud, which is usually a combination of water, dirt and various chemicals, is circulated down the drill pipe, out and around the drill bit and up outside the drill pipe through the drill casing, and back into conditioning pits on the ground, wherein the mud is reconditioned and recirculated back down the drill pipe once more. The need for the drill mud is such that the hydrostatic weight of the column of the drilling mud must always be greater than the pressure of the formation being penetrated or the pressure will overcome the weight of the mud and a blow-out will occur. Obviously greater drilling mud weights are necessary to drill through deeper and higher pressurized zones in todays deeper wells. This deeper drilling also causes many problems within the bore hole due to these higher mud weights, higher temperatures and increased friction. Additional problems within the bore hole are caused by an abundance of deviated bore holes, which are wells drilled intentionally at an angle rather than straight down so that the bottom of the hole will be located at a distance away from the surface location.

Throughout the course of the drilling process, during the completion or recompletion of an oil well, many electrical devices are lowered into the bore hole on what is called a wireline electrical cable from a surface recording unit. Many of the aforementioned drilling problems; increased temperatures, pressure, drilling mud weight and deviated holes, which are all effects of todays deeper drilling, frequently cause these electrical devices to become stuck in the hole, and are many times therefore unretrievable. The loss of one of these electrical devices is not only expensive in itself, but results in the loss of drill time and the loss of very valuable information generated by the unretrieved logging devices. Thus, if the electrical device cannot be retrieved, tools must be lowered into the hole by the drill pipe to either grind up the unretrievable electrical device and retrieve the pieces in a basket, thereby removing the obstacle or redrill the obstructed hole.

An additional problem is encountered in the lowering of these electrical logging devices through the heavy mud weight being used today as heavy mud has a tendency to congeal and even to solidify. The existing electrical devices have reduced weight, of course, when lowered into water, so their weight almost becomes nonexistant when they are placed in a super saturated, heavy drilling mud. Suspension of these devices in the mud causes them to travel very, very slowly down the bore hole and have a tendency to drift within the hole and also to become lodged on any small obstruction within the bore hole. The deep and deviated wells frequently have bridges, ledges and washouts i.e. changes in the diameter of the hole which also cause the electrical devices to hang up, therefore preventing them from getting down to the desired depth.

Several patents have been found in the art which speak to apparatuses for lowering down a drill hole. The most pertinent being as follows:

U.S. Pat. No. 4,166,500 issued to W. A. McPhee entitled "Well Logging Method and Apparatus Using Friction-Reducing Agents" discloses the use of a well logging instrument having a fluid chamber at its lower end which maintains friction reduction agent, and a means in the apparatus for forcing the friction reduction agent into the bore hole at various points along the length to facilitate movement of the apparatus through the bore hole. The apparatus is an electronic instrument that is lowered by cable with electricity being fed along the cable.

U.S. Pat. No. 3,177,938 issued to R. Roussin entitled "Methods and Apparatus for Operating Borehole Equipment" discloses an apparatus which would enable one to operate a tool and a well in various differences in the hydrostatic pressure of the well liquid at different levels in the well. Essentially, the pressure in the apparatus is maintained to the pressure of the hydrostatic pressure at the various levels, and the tube is able to operate at a different level with the pressure in the tube being the same as the hydrostatic pressure.

U.S. Pat. No. 4,192,380 issued to John R. E. Smith entitled "Method and Apparatus for Logging Inclined Earth Boreholes" discloses the method and apparatus of logging formations surrounded earth boreholes by having an elongated well logging instrument connected to the earth's surface by a well logging cable at least two pad members which make contact with the edges of the borehole for transmitting a control signal for operation of the apparatus.

U.S. Pat. No. 3,692,106 issued to E. R. Basham entitled "Apparatus for Ejecting Fluid in a Borehole", U.S. Pat. No. 1,230,666 issued to D. A. Garden entitled "Cleaning Device for Wells" and U.S. Pat. No. 2,187,845 issued to E. Tatalovich entitled "Clean-Out Tool" and U.S. Pat. No. 3,799,276 issued to K. Matsushita entitled "Fluid Driven Below Ground Motor for Sinking a Caisson" all teach various down hole devices.

SUMMARY OF THE PRESENT INVENTION

The apparatus of the present invention would solve the problems encountered in the present state of the art, through the combination of mechano electrical components to provide an apparatus for assisting electrical devices, in particular, logging equipment being lowered down and retrieved from primarily open bore holes, being uncased holes, but also completed or cased holes of oil wells or other holes drilled in the earth's surface having similar problems. The apparatus would comprise in combination, an upper sub for connectable engagement with the wire line, a microprocessor component for directing the various functions of the overall apparatus down hole; a motor section having a plurality of thrust directional motors and ball screw assembly for movement of steering gates; a motor driven impellar means for providing thrust and flow through a portion of the apparatus and in combination with the flow gates providing steering in a certain direction; an electric transducer portion for providing ultrasonic vibrations around the circumference of the apparatus in discongealing molecular substrate adjacent the apparatus; a mechanical vibration coil assembly means on the lower end of the apparatus for descongealing larger areas of congealing in a substrate around the apparatus, and a lower sub for connectably engaging the electrical unit to be steered down hole. The apparatus may also comprise on either end a thrust explosive sub for explosively dislodging the apparatus in the event of lodging occuring downhole.

Therefore, it is an object of the present invention to provide an apparatus for inducing and assisting electro tool in their journey down and from an oil well bore;

It is a futher object of the present invention to provide an apparatus having a plurality of means for steering, thrusting, or dislodging a tool lowered downhole.

It is still a further object of the present invention to provide an apparatus which, guided by an inhouse microprocessor, provides the proper guiding, thrusting and lateral movement of the apparatus downhole.

In order to accomplish the above objects of the present invention, it is a primary feature of the apparatus to provide an upper motor section having thrust directional motors and ball screw assembly for operating steering gates in the wall of the apparatus;

It is an additional feature of the apparatus to provide an impellar within the apparatus on one hand thrusting the apparatus down hole and on the other hand thrusting the apparatus uphole and in conjunction with the aforesaid gates, providing lateral steering movement of the apparatus both down hole and up hole.

It is still a further feature of the apparatus to provide a piezo electric transducer component for providing ultrasonic energy around that portion of the apparatus for breakup of molecular congealing of the substrate;

It is still a further feature of the apparatus to provide a mechanical vibration coil assembly for mechanically discongealing the substrate around that portion of the apparatus through vibration;

It is still a further feature of the apparatus to provide an explosive sub for providing retro-thrusting of the apparatus in the event the apparatus becomes lodged down hole.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein:

FIG. 3-A is a perspective view of the gate member of the present invention;

DETAILED DESCRIPTION OF THE PREFERRED EMBODIMENT

FIGS. 1 through 10 illustrate in partial crosssectional views, the preferred embodiment of the apparatus of the present invention, along a continuous longitudinal cross-sectional axis that will be described more fully below.

Apparatus 10, as a whole, of the preferred embodiment, comprises a top interchangeable sub; a bottom interchangeable sub; primary components of an electronic assembly; a motor section with thrust directional motors; a thrust impeller section; a thrust drive motor section; an electric tranducer section; and a mechanical vibration coil assembly; all components therebetween the top and bottom interchangeable subs. There is further provided as an alternative feature, an explosive propellent charge sub-assembly which can be positioned at either end of the apparatus, the function of which will be explained further. In order to more properly describe the function of each particular section, each section will be discussed individually, making reference to the appropriate FIGURES, for a thorough discussion of the entire invention.

Figure 2:
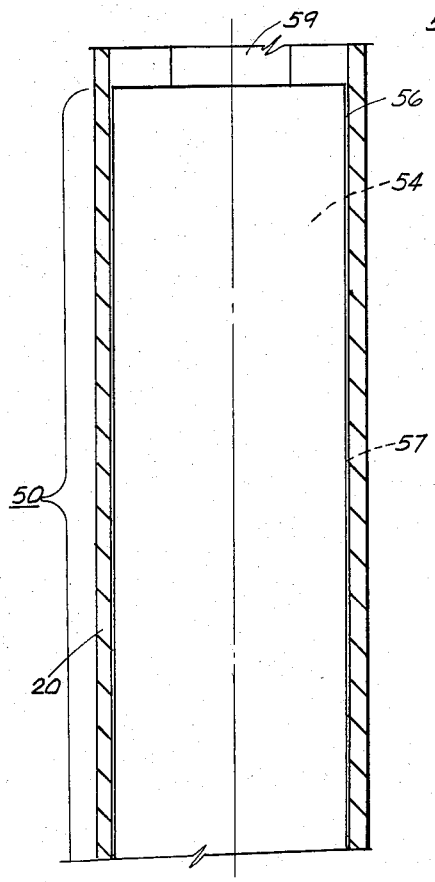
FIG. 2 is a cross-sectional view of the interspace within the apparatus housing the electronic assembly and micro processor in the unit of the preferred embodiment of the apparatus of the present invention.
Figure 1:
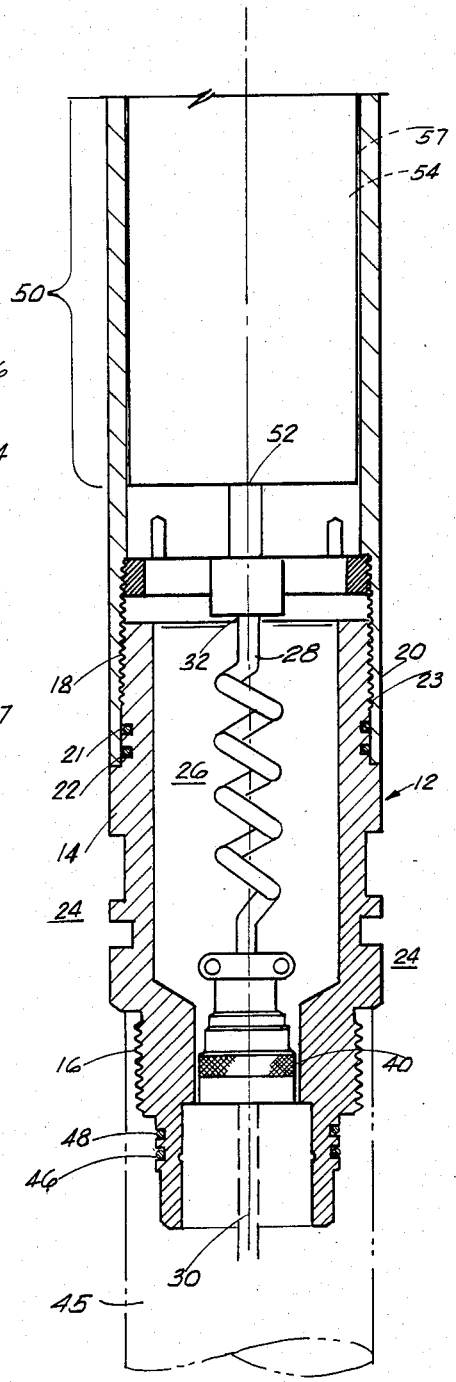
FIG. 1 is a side cross-sectional view of the interchangeable top sub-portion of the preferred embodiment of the apparatus of the present invention.

FIG. 1 illustrates in cross-sectional view, primarily the interchangeable top sub/portion of the preferred embodiment of the apparatus of the present invention as illustrated by the number 12. Top sub 12 is substantially a tubular shaped portion having a continuous side wall 14 with threaded portions 16 and 18 at either end. Sub 12 would threadably engage threaded wall portion 20 of the main body portion of apparatus 10, with male threads 18 of sub 12 engaging female thread portion 23 of apparatus 10. At the point of connection, as illustrated in FIG. 1, there is provided a double O-ring 21 and 22 for preventing any fluid, such as drilling fluids or the like from the surrounding hole 24 from entering into the inner chamber 26 of sub 12. As further seen in FIG. 1, top sub 12 provides an interior chamber 26 which houses electrical wire line 28 as wire line 28 extends from the end portion 30 through sub 12 into the main body portion of apparatus 10 and connecting thereto at point 32. Wire line 28 basically comprises a plurality of electrical conducting wires for providing electrical power from the rig floor to the apparatus 10 for operation thereto. Interchangeable top sub 12 further comprises connector means 40 which is substantially a flip type connector having electrical points of contact (not seen in drawing), which are typical plug type contacts for connecting the wire 28 (as seen in phanthom) from the rig floor to be connected onto the sub itself. Sub 12 further provides on its second end, threads 16 which would adapted to threadably engaged bridle 45, (phantom line) which is a flexible connector component, known in the art, substantially 20 feet in length and would threadably engage between the wireline and the sub as illustrated in phanthom view. The bridle 45 is not part of this invention, but is a typical bridle utilized in the drilling field having electrodes or the like for inserting into connector means 40 and interconnecting the electrical source with the apparatus. Likewise, there is further provided double O-rings 46 and 48 which also provide fluid tight seals between the exterior substrate 24 and the inner chamber 26 of sub 12 in order to prevent fluid from seeping into the connector means and damaging the electrodes and wireline.

It should be noted that in this particular type of sub 12, although this is a preferred embodiment, the interchangeable sub is interchangeable in order to accommodate the various downhole eletric tools onto the apparatus, manufactured by Schlumberger, McDermott, or others. Therefore, this interchangeable sub would be of different dimensions in certain instances depending on the particular logging instrument utilized in the particular job.

Turning now to FIGS. 2 through 8, a discussion will be had of the primary invention, namely the combination of components making up this particular apparatus. As was discussed earlier, apparatus 10 comprises a substantially tubular shaped body having a continuous wall portion 20 of steel or the like, the interior surrounded by wall portion 20 defining the interspace in which the functioning components of the apparatus are housed. Apparatus 10, would have at its first end a female threaded portion 23 for connecting onto interchangeable top sub 12 as was discussed earlier. The first section of apparatus 10 would be the electronic assembly micro processor section 50 which is best illustrated in the circuit drawings in FIGS. 10 and 11, with this section 50 housing the electrical circuitry for the micro processor which would be fed by electrical wireline 28 into the micro processor at point 52 with micro processor being housed in space 54 which is shown as a blank space in the drawings as was explained earlier. It should be noted that space 54 has exterior wall 56 which is a separate wall portion from the exterior wall 20 of the apparatus. The inter space 57 between wall 56 and wall 20 which would preferably house a type of silicon oil for providing an equalized pressure within the apparatus from the pressure without the apparatus as will be discussed in further detail. Naturally, the micro processor assembly 50 would provide electrical impulses or the like at its lower end 59 into the next section of the apparatus via continuous line 28 which, as was discussed further, is a primary electrical feed line for all functions of the apparatus which runs continuously through the apparatus.

Figure 3:
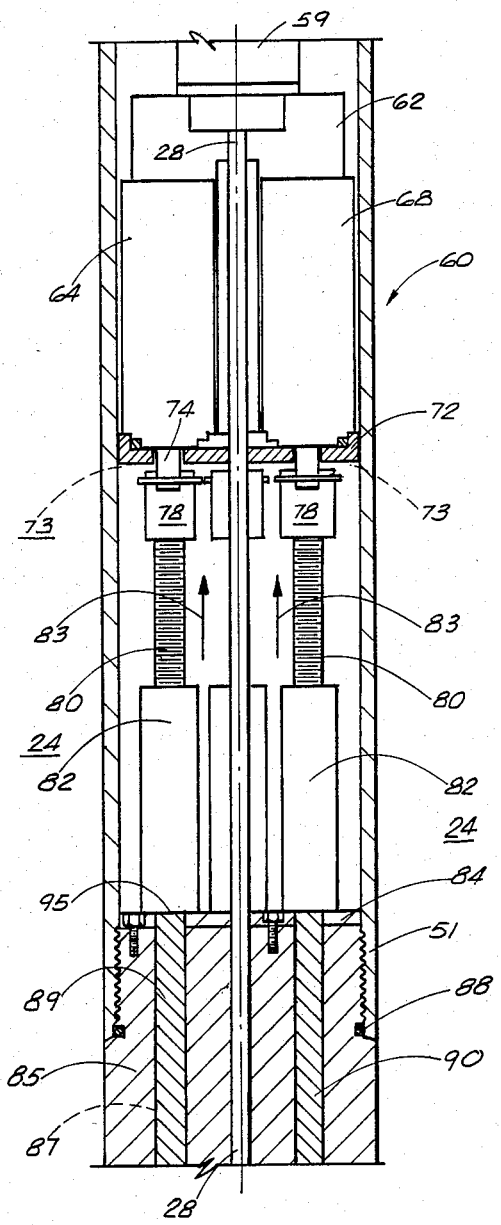
FIG. 3 is a cross-sectional view of the preferred embodiment of the apparatus of the present invention illustrating the motor section including the thrust directional motors and ball screw assembly.
Figure 3A:
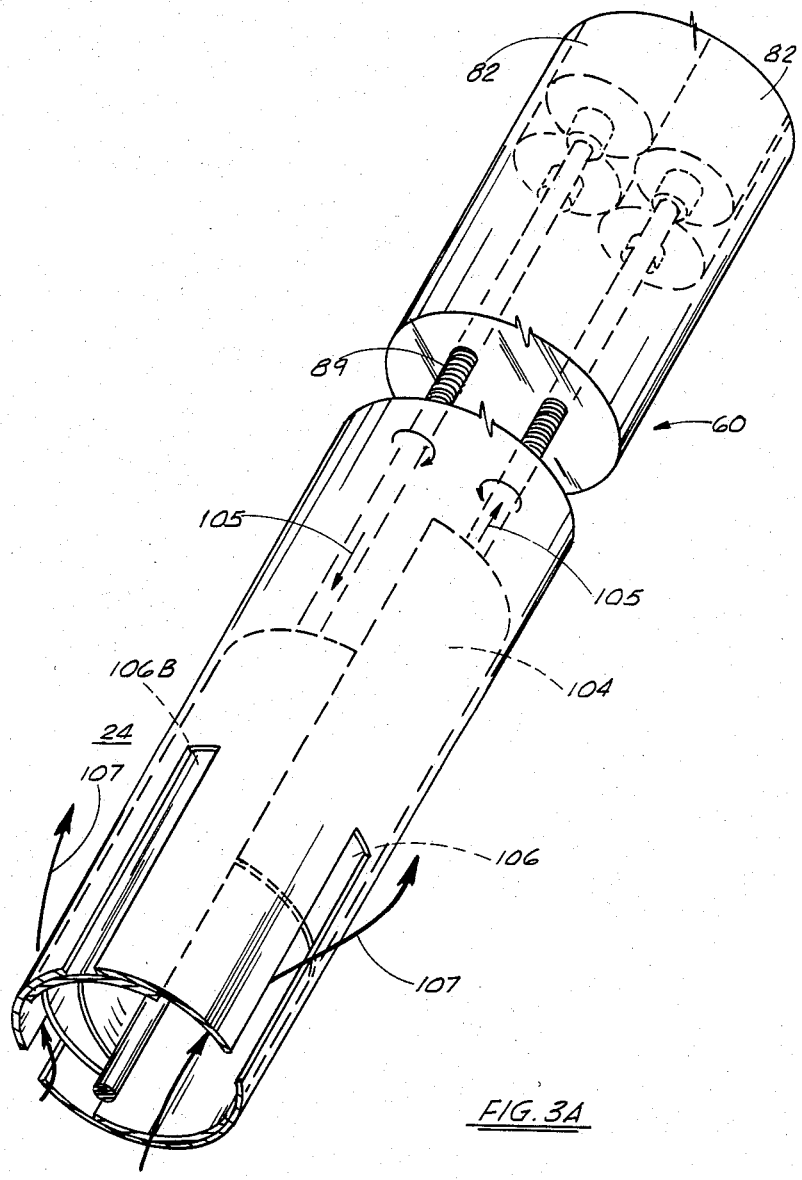

The first mechanically operative section of the apparatus adjacent the micro processor is the motor section with thrust bi-directional motors, the motor section being indicated by numeral 60, in FIGS. 3, 3A and A. Motor section 60 would be provided on its first end, i.e. that end adjacent the micro processor section 50, a mounting means 62 which would be securely mounted to the end portion 59 of micro processing unit 50, with the mounting means comprising basically a metal mounting bracket or the like. Mounting means 62 would be mounted to a plurality of bi-directional drive motors 64, 66, 68 and 70, illustrated in FIG. 3 and 3-A. It should be noted that although drive motor 64 and 68 are illustrated, there are 4 drive motors substantially equidistant apart around the circumferential space within apparatus 10, the function which will be described further. Bi-directional drive motors 64 through 70 would be secured in place with mounting plate 72 on their second end, said mounting plate being adapted with a plurality of bores 73 for providing a through port for drive shafts 74 of motors 64 through 70. Shafts 74 of the plurality of drive motor 64 through 70 would be adapted at their furthest end onto ball screw assembly mount 78 which would be firmly mounted to shafts 74, so that rotation of shaft 74 would impart rotation to ball assembly mount 82. As seen in the FIGURES, ball screw assembly 82 comprises a mounting base 78 mounted to shafts 74 on its first end and extending integral to a threaded shaft portion 80, with the ball screw assembly itself threadably engaged to shaft 80 for movement thereupon. In describing the function of ball screw assembly 82, arrows 83 illustrate the movement of ball screw assembly 82 downward toward base 78 as shaft 74 is rotated which would impart rotation to threaded shaft 80.

It should be made clear that each drive motors 64 through 70 would function independently of one another, with each drive motor operating a separate and individual ball screw assembly 82. This is imperative in the functioning of ball screw assembly 82 which will be described further.

Figure 4:
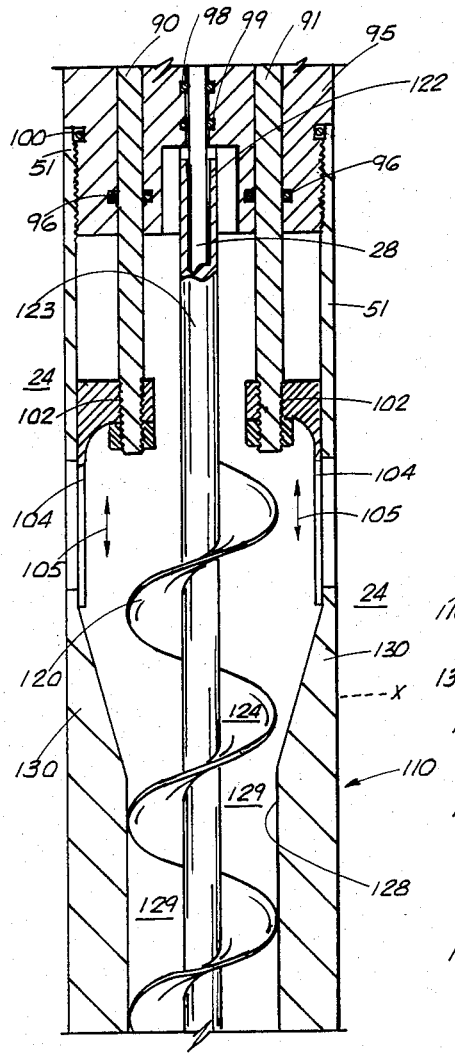
FIGS. 4 and 5 illustrate the thrust impeller assembly in the preferred embodiment of the apparatus of the present invention.

Ball screw assembly 82 is attached on its second end to mounting plate 84 which is affixed to an inter unit sub 85 with sub 85 being threadably attached to the wall portion 51 of apparatus 10. Sub 85 is positioned at this point so that access can be had by threadably disengaging thrust motor section 60 in order to have easy access to the individual ball screw assemblies 82. As seen in the FIGURES, there is provided O-ring 88 at the juncture of motor section 60 and inter sub 85 again to prevent fluid contact from the outside into the assembly unit. Sub 85 provides a plurality of bores 87 for housing shafts 88, 89, 90 and 91 respectively each shaft connectably engaged at point 95 to each separate ball screw assembly 82. Shafts 88 through 91 are substantially hard metal shafts which will move according to the movement of ball screw assembly 82. Again, as illustrated in FIG. 4, each shaft 88 through 91 is provided with an O-ring seal 96 between the wall portion of sub 85 which is contiguous with shaft 88 through 91 so that fluid leakage is prevented from occuring between the shafts 88 through 91 and the wall of sub 85. Likewise, there is provided double O-rings 98 and 99 between again the wall portion of sub 85 and continuous electrical wire 28 that runs through the apparatus for feeding electrical power to each component.

The lower most portion of sub 85 is again threadable engaged to the wall 51 of apparatus 10, again provided with O-ring 100 for preventing fluid leakage thereinto. Following the threadably engagement of sub 85 onto the next portion of apparatus 10, as seen in the FIGURES, shafts 88 through 91 protrude out of the lower end of sub 85, and/or threadably attached at point 102 to a plurality of slideable gates 104 which can be imparted with movement upward and downward as illustrated by arrow 105.

Although the functioning of gates 104 will be discussed further, the movements of gates 104 is imparted by the movement of ball screw assembly 82. In describing this function, returning back to motor 64 through 68, as an example drive motor 64, upon imparting electrical power to drive motor 64, shaft 80 would be rotated with ball screw assembly moving in the upward or downward direction depending on the direction of the rotation of shaft 80. Upon ball screw assembly moving upward or downward, shaft 89 would likewise move in the up or down direction imparting upward or downward movement to gate 104. In this particular example, gate 104 would normally, in the down position, block flow through extended port 106B from the outside (See arrow 107 in FIG.3-A), and in the up position allow flow therethrough. The function of port 106, which would be a plurality of ports around the circumference of apparatus 10, each port being coincident with a particular gate 104, will be more fully discussed in the "Operation of the Apparatus".

Figure 5:
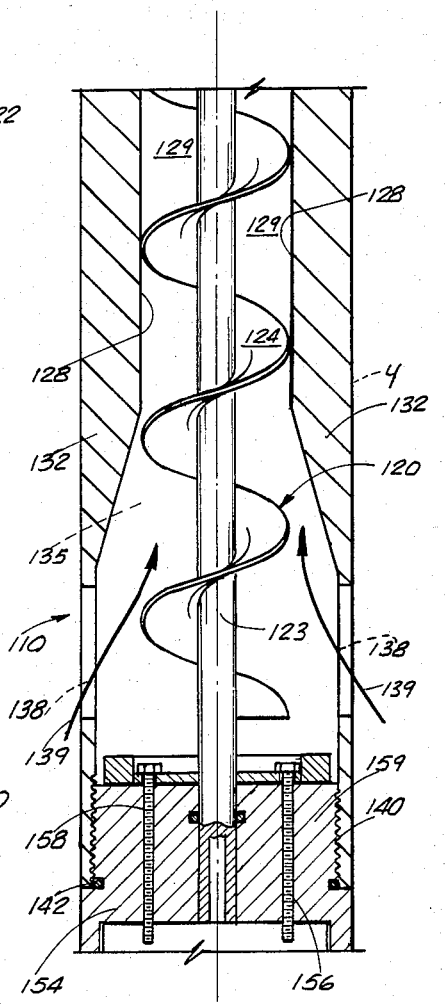
Figure 6:
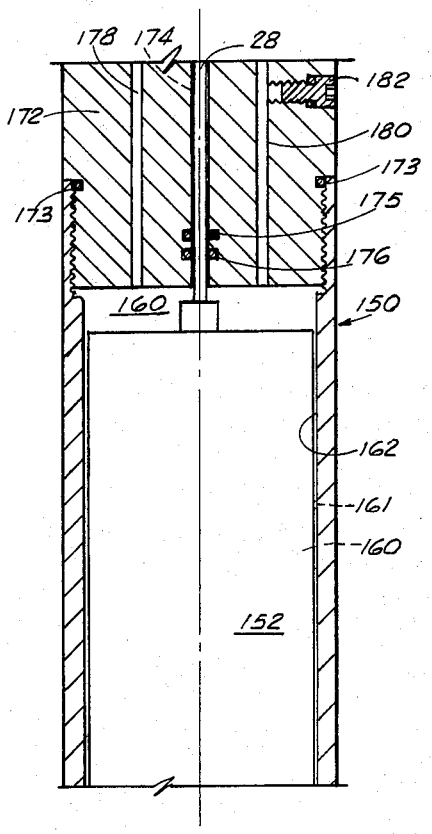
FIG. 6 illustrates the connection between the impeller section and the thrust drive impeller motor in the preferred embodiment of the apparatus of the present invention.

In discussing the functioning of the next section of the apparatus, i.e. the thrust and impeller section 110, as seen in FIGS. 4 and 5 it is best discussed in conjunction with thrust drive motor section 150 as illustrated in FIG. 6.

Thrust impeller section 110 for the most part, houses extended impeller 120, as seen in FIGS. 4 and 5, extending from its upper most point at mounting portion 122, i.e. mounted in a bottom most portion of sub 85, for allowing rotation of the shaft portion 123 of impeller 120. Impeller 120 further provides continuous annular blade portion 124 which extends substantially the length of shaft 123 through section 110, in a type of cork screw fashion for allowing flow of fluid therethrough as blade 124 is rotated. Impeller section 110 as is stated earlier, is threadably engaged to the lower portion of sub 85, which provides a continuous wall portion 51 as does the previous sections. It should be noted here, that wall 51 becomes substantially thickened between points X and Y, so that the inner most surface 128 of wall 51 substantially abuts the outer most point of cork screw impeller 124 as is illustrated in FIG. 4 and 5. Therefore, any fluid flow through the space 129 defined by the inner most surface 128, between points X and Y must flow within the confines of blade 124 rather than around the outer edges of blade 124. This would provide better movement of fluid through the apparatus, the function of which will be described further. As seen in the FIGURES, wall 51 which substantially houses impeller 120 from the point at which gates 104 join wall 51 in the closed position, slope inward along the sloping shoulder portion 130 to the desired thickness at interior surface 128 and likewise at the second end of the wall portion of a second sloping shoulder 132 to return to the normal thickness of wall 51. Therefore, at either end portion of impeller 124, there is provided a greater interior space 135 than the interior space 129 between continuous inner surfaces 128. This would allow greater fluid accumulation at the entrance and exit of fluid flow through impeller section 110.

Earlier, there was described fluid flow through interior 129 of the apparatus, as the impeller was operated. This fluid flow would be directed from the exterior of the apparatus in surrounding area 24 which would be drilling fluid or the like. In order to obtain this flow, there is provided at the lower end of impeller 124 a plurality of openings 138 which, unlike openings 106, have no accommodations for a movable gate or the like, but simply allow fluid flow therethrough as seen by arrows 139. However, it can be seen in the FIGURES that although fluid is allowed to flow into ports 138 and up around impeller 120 to ports 106, if gates 104 are in the closed position, fluid will be blocked (see FIG. 3-A). Thus the spaces substantially 129, 135 and 136 will be filled with fluid allowing no additional fluid to flow into ports 138. Therefore, there will be no fluid flow through the spaces unless and until at least one gate 104 is at least in the partially opened position. The reasons for opening and closing of gates 104 shall be discussed further in the "Operation of the Apparatus."

The lower most end of thrust impeller section 110, like the previous section, is threadably engaged to the next lower thrust drive motor section 150 via threads 140. It should be noted again there is provided an O-ring 142 to sealably engage any fluid flow from the outside which may leak into threads 140. As was also discussed earlier, bi-directional thrust drive motor section 150 substantially accommodates bi-directional motor 152 which like the previous functioning aspects of apparatus 10 is provided with electrical power via continuing electrical line 28 for functioning. As seen in the drawings, motor 152 is housed within a sub 154 which is mounted via a pair of mounting screws 156 and 158 at its upper most end through the top portion 159 of sub 154. Of course upon imparting electrical power to motor 152, shaft 123 is rotated either direction as selected thus imparting rotation to cork screw impeller 124 in the movement of the impeller. Motor 152, in the preferred embodiment, would be able to accommodate a plurality of speeds and thus depending on the need for power, would function accordingly. Like the micro processor section 50 as was discussed earlier, motor 152 is housed within an annular space 160 of sub 154, providing a space 161 between the wall portion of motor 152 and the inner surface 162 of sub 154. This space is filled with silicon oil which provides equal and opposite force should excessive force be exercised on the outer wall of the apparatus which could do damage to the motor housed within sub 154.

Figure 7:
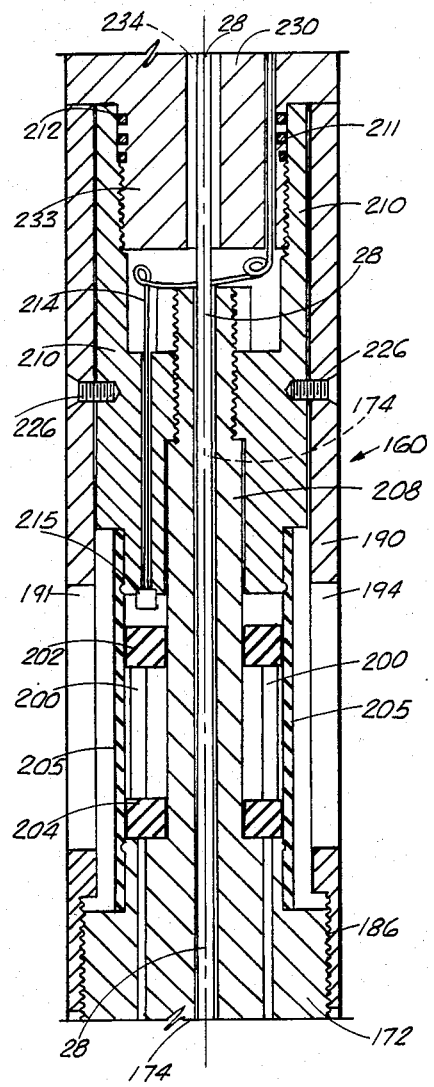
FIGS. 7 and 7*a* illustrate the electric transducer section in the preferred embodiment of the apparatus of the present invention.
Figure 7A:
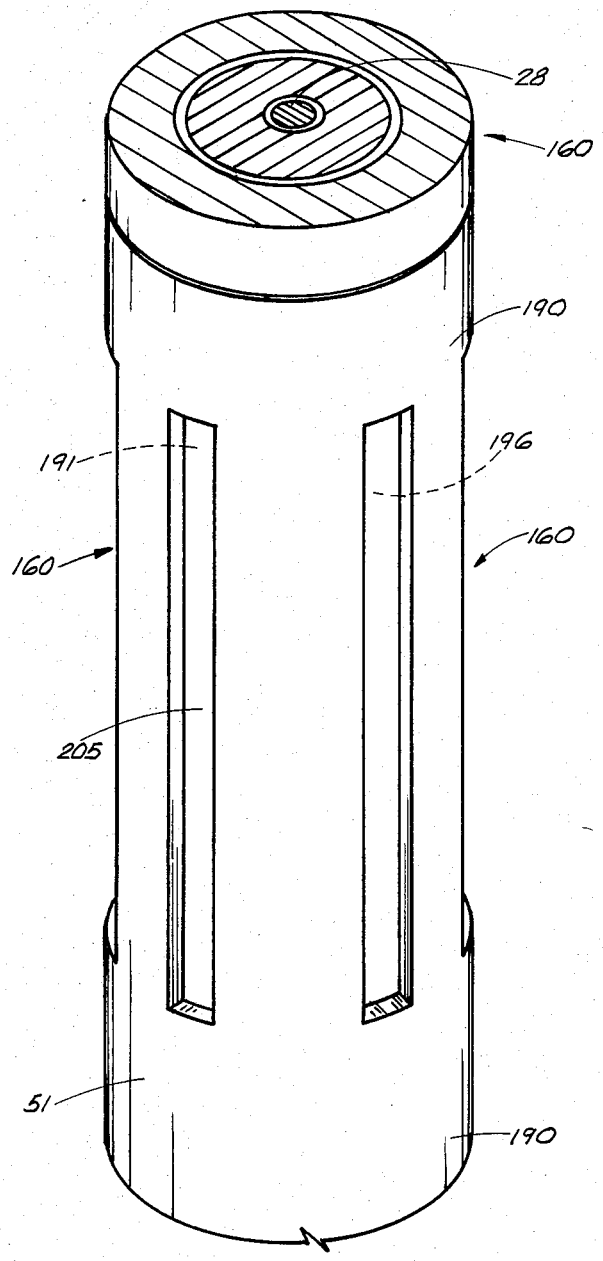

FIGS. 7 and 7A illustrate the next section of apparatus 10 being electric transducer section 160, being of the type manufactured by Piezo Electric, Inc. Section 160 comprises several interconnecting sub units each of which will be described individually together with their relationship to the several other components. Within transducer section 160, there is provided upper sub 172 which threadably engages to the lower portion of thrust impeller section 150 again providing an O-ring 173 for fluid tight connection there between. Sub 172 further provides an interior continuous bore 174 for housing continuous electrical wire 28 for providing electrical energy thereto. Contained within bore 174 is a pair of O-rings 175 and 176 which again provide a fluid tight seal between bore 174 and the exterior, particularly space 160 which is filled with silicon oil. There is further provided a pair of bores 178 and 180 running through the body portion of sub 122 wherein said bores 178 and 180 are in fluid communication with space 160 for receiving thereinto silicon oil also. Body portion 172 also provides filling screw 182 which is removable for injecting silicon oil via bore 178 into space 160 for providing oil surrounding motor 152 and into bores 178 and 180. Sub 172 also provides an upper threaded section 186 which threadably engages at its lower end an extended exterior collar section 190 with collar 190 adapted with a plurality of 6 slots 191 through 196 opening to the exterior of apparatus 10. Contained within collar portion 190 is an electric transducer section itself. This comprises an interior ceramic electric transducer 200 which is substantially a collar mounted on either end by mounting by rubber mounts 202 and 204. Completely surrounding the translucent 200 there is mounted a continuous rubber boot 205 which provides protection of translucent 200 from the exterior drilling fluid and the like which would be accessible to the transducer.

It should be noted that interior to the transducer is metal shaft portion 208 which is a shaft integral from the body portion of sub 172 and also having an interior bore 174 for housing electrical wire 28 as it travels through apparatus 10. Shaft 208 connectably engages a second lower interior sub 210 via threaded portion 233. Upon threadably engaging shaft 208 onto interior sub 210 provides a removable means for obtaining access to electric transducer section 160 which is housed between the body portion of lower sub 172 and the upper portion of interior sub 210. Interior sub 210 would threadably engage at its lower most end with a male portion of the next lower sub again providing a pair of O-rings 211 and 212 for providing again a fluid tight seal between the interior and the outside of the apparatus.

As is further seen in FIG. 6, at the end point 213 of shaft 208, electrical line 214 branches off from primary electric wire 28 to provide electrical power via connector wire 215 to internal transducer 200. Upon electric power being provided therethrough, transducer 200, as is common, would emit ultrasonic waves outward of the transducer into the area surrounding the apparatus. So that the ultrasonic energy from the transducer can be made accessible to the exterior of the apparatus, vertically disposed slots 191 through 196 provide exterior access for ultrasonic waves to exit through the slots into the surrounding media of the apparatus the function of which will be explained further. It should be further noted that collar 190, as was discussed earlier is mounted via threadably engagement at point 186 to sub 172, on its lower most end is engaged against the interior sub 210 via a plurality of mounting screws 226, therefore obtaining total stability along the length of collar 190.

Figure 8:
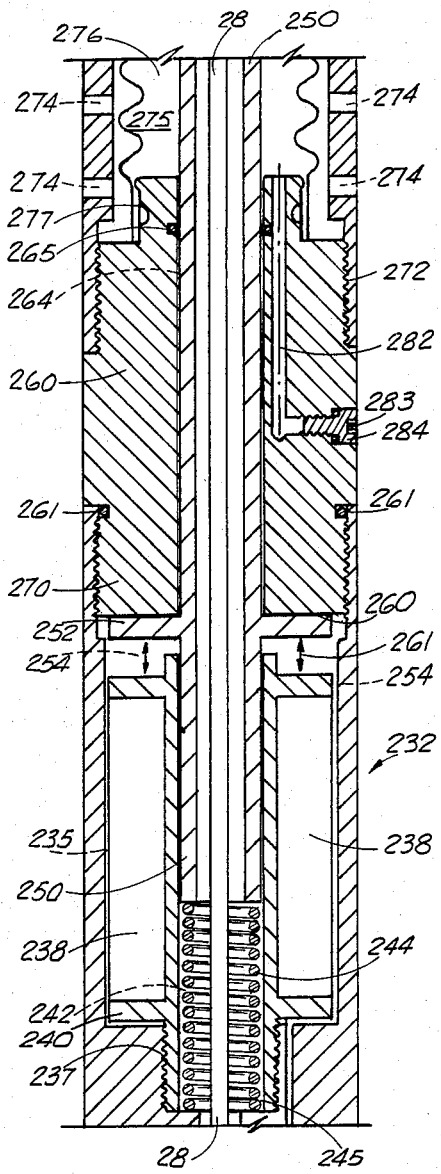
FIG. 8 illustrates the mechanical vibration coil assembly in the preferred embodiment of the apparatus of the present invention.
Figure 10:
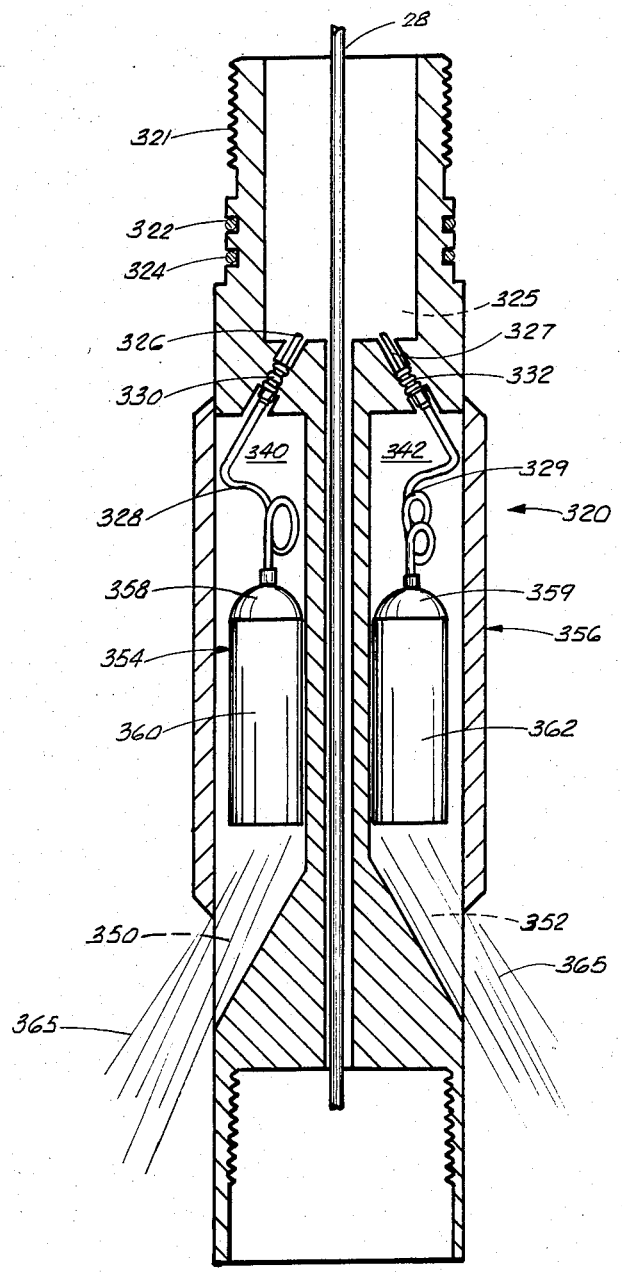
FIG. 10 illustrates the explosive propellent charged sub-assembly in the preferred embodiment of the apparatus of the present invention.

There is threadably engaged to interior sub 210 housing sub 230 as seen in FIGS. 7 and 8, which for the most part would house mechanical vibration coil assembly 232. Sub 230 comprises upper male thread engaging portion 233 which threadably engages the lower most portion of sub 210 and further provides a pair of O-rings 211 and 212 for a fluid seal there between. On its lowermost end, sub 230 threadably attaches to connections sub 160, with O-rings 261 providing a fluid-tight seal to the outside. Sub 230 further provides interior bore 234 which houses continuous electric line 28 through its interior and provides an interior annular space 235 for housing vibration coil assembly 232. Coil assembly 232 further comprises a spring loaded solenoid 238 which threadably engages into the interior of sub 230 at threads 237, solenoid 238 comprising mounting portion 240 which is substantially an annular mounting means with an interior bore 242 surrounded by solenoid coils 243 housed within bore 242 is spring 244 which is biased against the interior upper shoulder 245 defining the upper most wall of bore 242 with spring 244 extending to its lower most end in contact with extendable shaft 250. Shaft 250 extends into the next series of subs the function of which will be explained further. Approximately one third down shaft 250 is annular shoulder portion 252 which rests between the end portion of solenoid housing 240 and lower next sub 260. As seen in the FIGURES, shoulder 252 is abutting the upper most edge of connecting sub 260, and there is provided a space 254 between the lower most edge of solenoid housing 240 and shoulder 252 so that upon the activation of solenoid 238, wherein spring 244 is retracted, shaft 250 is allowed to move upwardly within that space to provide the necessary vibration of mechanical vibration coil assembly 232, preferably at a speed of 60 cycles per minute (see arrows 261). As is seen in the FIGURE, shaft 250 extends through a bore 260 through the center of connecting sub 264 with O-ring 265 providing a fluid tight seal between the wall of shaft 250 and the inner wall of bore 264 in order to prevent fluid contact with vibration coil assembly 232. The lower portion of connecting sub 260 is provided with male engaging portion 270 which threadably engages an annular collar portion 272 which is provided with a plurality of ports 274 throughout its length in order to accommodate the movement of fluid in and out of the portion as will be discussed further. Collar 272 houses shaft 250 which extends through the interior space of collar 272 and housing within its interior bore continuing electric line 28. There is provided rubber bellows 276 sealably attached at its upper portion 277 onto the lower most male portion 270 of sub 260 and on its lower most end to the next connecting sub 280. As seen in the drawings, the interior space 275 between rubber bellows 276 and the exterior wall of shaft 250 is filled with a type of silicon oil, preferably Dow Corning 200 fluid. As seen in the FIGURE, silicon oil is inserted into the rubber bellows via the insertion channel 282 which extends from the interior of boot 276 through the body portion of sub 260 and outward to the interior at point 283 which is normally pluged by plug screw 284. In order to maintain the oil within bellows 276, there is provided upper O-ring 265 between the body of sub 260 and the shaft 250, and the lower O-ring 284 which provides a fluid tight seal between the body portion of next connector sub 280 and the shaft 250. Therefore, the oil is maintained within the bellows between these two O-rings even as shaft 250 vibrates upward and downward. The lower most end portion of shaft 250 is threadably engaged to lower most connector sub 280, with the lower portion of sub 280 threadably connecting onto lower most interchangeable bottom sub 300. Connector sub 280 likewise has an interior bore 282 for providing a space for continuing electric line 28 to run therethrough with the lower most portion of sub 280 providing a female annular wall portion 286 the interior of which provides threads 288 for threadably engaging sub 300 thereinto. Likewise, there is further provided a pair of O-rings 289 and 290 for again affecting a fluid tight seal from the outside. It should be noted that there is provided a shoulder portion 291 on sub 280 which would have a space 292 between it and the lower most edge 293 of annular collar 272. This space is critical in view of the fact that as shaft 250 is cycled upward and downward between solenoid 238 and spring 244, the space would likewise provide a means for movement of the shaft connected onto the lower subs as the upward and downward movement occurs.

Figure 9:
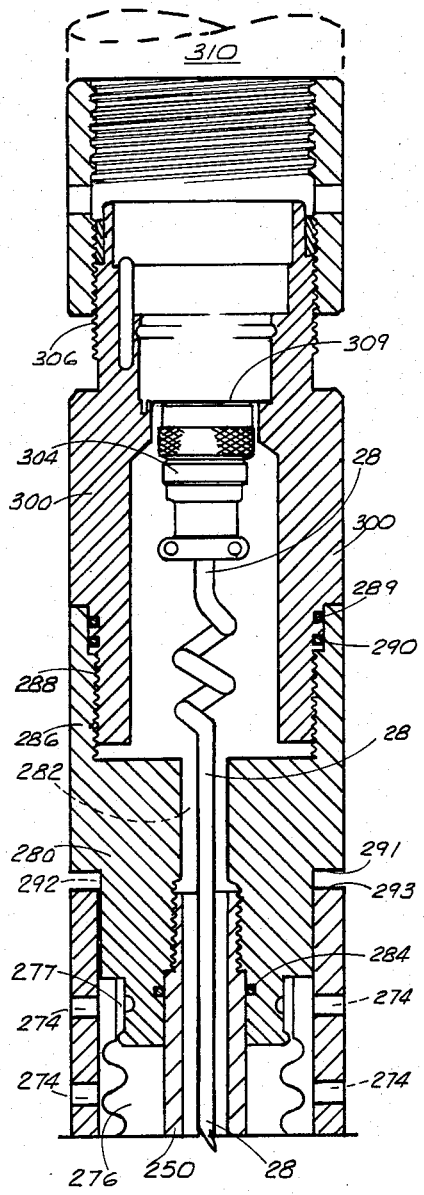
FIG. 9 illustrates the interchangeable bottom sub-assembly in the preferred embodiment of the apparatus of the present invention.

Like upper sub 12, bottom sub 300, as explained earlier, is threadably engaged to the lower most portion of connector sub 280, and also has an annular inter space 302 for housing electric line 28 as it connects onto the bottom connector portion 304 which would make mating contact with the logging equipment 310 as seen in phantom in FIG. 9. The lower most end of bottom sub 300 would be accommodated with male threaded portion 306 for threadably accommodating logging equipment 310, and following the threading of logging equipment onto the sub, electrical contact is made at point 309 for providing electrical power to the logging equipment as it is used down the hole.

Figure 12:
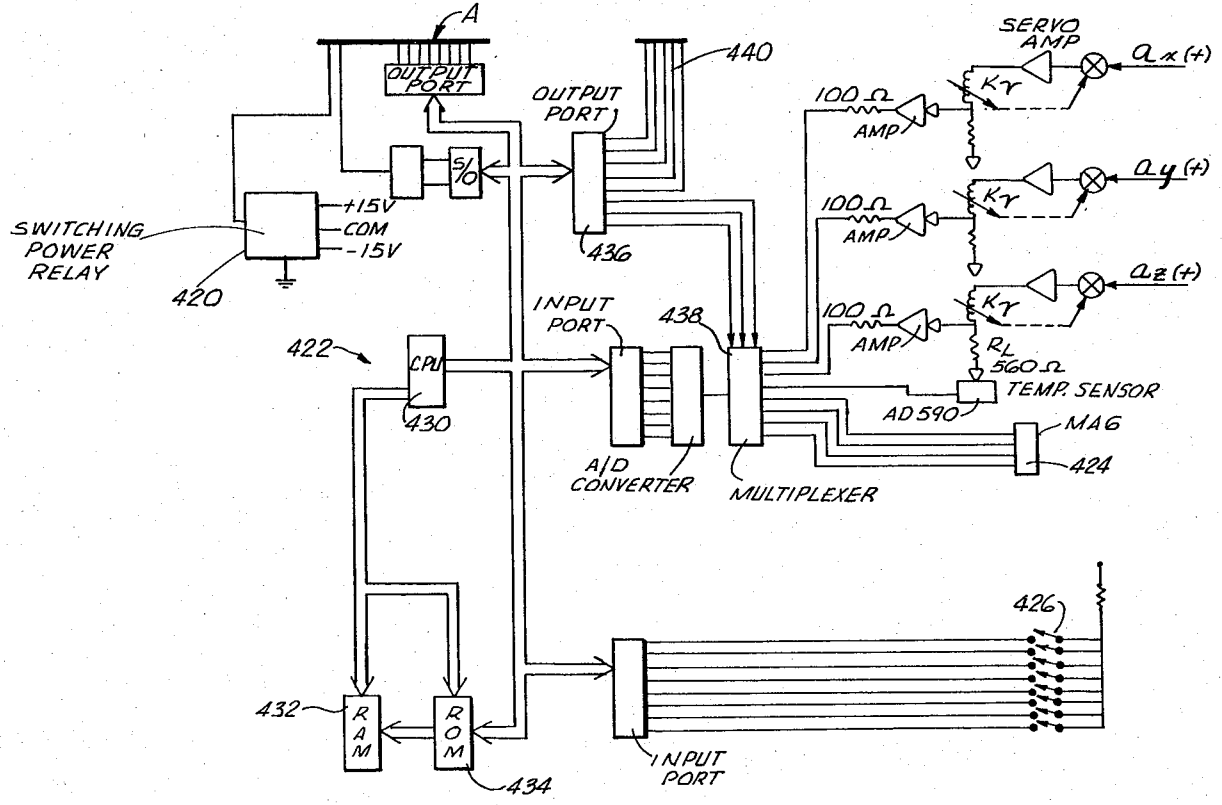

An additional component of the apparatus, which could be attachable between the upper end most portion of the apparatus and upper sub 12 or lower sub 300. This particular attachment would be entitled an explosive propellent charged sub 320 as seen in FIG. 12. Explosive sub 320 would provide on its first end a male threadable collar 321 for threadably engaging a portion of the apparatus 10. There is also provided a pair of O-rings 322 and 324 for disallowing fluid flow between the outside and the interior of the sub. Provided within the interior of sub 320 would be central bore 325 extending substantially the length of sub 320 allowing and providing a passageway for continuous electric line 28. Upon entering sub 320, electric line 28 would have a pair of electric feeders 326 and 327 each supplying electrical current to independent electric lines 328 and 329 at electrical connections 330 and 332 respectively. Lines 328 and 329 respectively would lead into a pair of chambers 340 and 342, each chamber being open ended to the surrounding exterior of sub 320 via portals 350 and 352. Contained within each of chambers and 340 and 342 is explosive means 354 and 356 respectively. Explosive means 354 and 356 would comprise detenator caps 358 and 359 connected to explosive charges 360 and 362 respectively. Should the apparatus become lodged in the well hole, one choice would be to supply electrical current to the detenator cap for detenating either explosive charges 360 or 362 depending on the relative lodging of the apparatus, with the explosive charge emitting a retro type of fire 365 through port 350 or 352 in order to push the apparatus upward were the lower explosive sub detonated or to push the apparatus downward were the upper sub detonated.

What follows is an explanation which provides the several uses of the apparatus as it is used downhole, together with the functioning of its combination of components in order to provide its varied and unique functions with this type of equipment.

OPERATION OF APPARATUS

In the use of apparatus 10, apparatus 10 would be threadably connected at its uppermost end to bridle 45 which would be a flexible connector approximately 20 feet in length and rubber coating housing electrodes and the like for providing electro connection between the wireline upon which the equipment is lowered down in the apparatus. As was stated earlier, in view of the fact that different manufacturers manufacture different sized linkages for bridles, apparatus 10 for connecting onto the particular bridle in use, would be provided with various sizes of interchangeable top subs 12 for connectively engaging apparatus 10 thereunto. At the lower most end of apparatus 10, again interchangeable bottom sub 300 like top sub 12, would be of varying sizes depending on the manufacturer of the logging equipment to be utilized in the particular downhole exercise. The logging equipment would be again threadably engaged to the bottom sub 300 and would be electrically connected within the linkage provided within sub 300 for electrical power to the logging equipment.

In explaining the operation of apparatus 10, it must be kept in mind that the apparatus is primarily a steering and guidance and thrusting tool utilized in lowering logging equipment down into the hole. Logging equipment, for the most part would be involved in sonic, nuclear or electrical measuring instruments lowered into the hole and recording the data for evaluation. The sensing logging equipment can transmit data on porosity, permeability, fluid content, types of fluids, sequence and composition of the formations, and the depths at which they occur. It is a very necessary part of drilling, and therefore it is vital that the logging equipment be lowered properly down into the hole with the minimum of problems encountered, and particularly, with the hope of not having the logging equipment lodged within the hole itself.

Therefore, following the connection of apparatus 10 intermediate the bridle and the logging equipment, the apparatus and its connecting units would be lowered into the hole. Electrical power would be provided from the well surface via electrical line 28 so that all aspects of the apparatus together with the functioning of the logging equipment itself is provided with a source of electrical power. Briefly concerning the functioning of micro processor 50, the circuity of which was outlined in detail earlier in the specification, it should be kept in mind that micro processor 50 maintains constant evaluation on the functioning of the various aspects of the tool, including sensing the position of the tool down the hole, the relative inclination and direction that the tool is traveling down the hole, and automatically provides steering and automatically provides the necessary signals for maintaining the proper functioning of the tool so that it accomplishes its task in working with the logging equipment.

The first mechanical functioning of the tool itself adjacent the micro processor and working directly below it would be motor section 60 which comprises the 4 thrust bi-directional motors and ball screw assemblies 64 through 70 respectively. In comprehending the functioning the motor section, it must be explained in detail with the thrust impeller section also. The motor section 60 and thrust impeller section 110 are the primary means for providing vertical and lateral steering guidance and thrust to the apparatus up and down within the hole. As was stated earlier, there is provided in the thrust impeller section, thrust drive motor 152, which is like all items within the tool electrically driven and with the proper gear ratio to provide the proper speeds. Thrust motor is connectedly engaged to shaft 123 which is positioned between lower thrust motor 152 and upper mounting means 122. Rotation of shaft 123 imparts rotation to cork screw impeller blade 124 extending substantially the length of shaft 123. In the wall of the apparatus is a plurality of ports 138, preferably 4 in number which would allow fluid flow as seen by arrows 139 into ports 138 being carried upward via the rotation of blade 124 to the upper space 129 within thrust impeller section 110. Of course, in order for the impeller to properly provide thrust to the apparatus, it is necessary that the fluid flow within the impeller section be allowed to flow out of the impeller section so that a continuous flow therethrough may be maintained. This is a functioning of the motor section 60 together with the ball screw assembly 82. At the upper portion of the thrust impeller section 110, there is further provided a plurality of ports 106 which for the most part coincide to the plurality of lower ports 138. However, ports 106, are provided with gates 104 which are movable upward and downward via the ball screw assembly 82 for allowing flow through ports 106 when gates are up, and to block flow therethrough when the gates 104 are down. Preferably, since each particular port 106 is positioned within a one quardrant of the circumferential wall of the apparatus 10, each gate 104 is independently operated by a separate ball screw assembly 82 and separate drive motor 68 through 70. Therefore, should one wish to lower or raise a particular gate 107, a particular drive motor is actuated, upon rotation of shaft 80, ball screw assembly together with lower shaft 89 which is connected to each gate 104, is likewise raised upward imparting upward movement to the particular gate 104 for allowing passage through port 106.

Of course this raising and lowering of the individual gates is a function of the micro processor which monitors the position of the tool, and depending on the slight adjustment in the downward movement of the tool, than the micro processor would sense, a particular gate or plurality of gates would be opened or closed accordingly so that flow through the apparatus would be accommodated in a certain direction as it exited a particular gate, in order to serve as a type of outward thrust for moving the apparatus in a particular direction. In the event all gates are open, flow would be directed from all ports in a similar thrust, thus the tool would be in a stable position. Likewise, should all gates be closed, there would be no flow through the impeller section thus there would be no thrusting in a particular direction.

This particular means of movement of the tool laterally within the borehole, is important in view of the fact that in certain circumstances the logging equipment as it is lowered into the hole may reach what is called "shelf" within the hole and become lodged on that shelf. Therefore, in order to get the logging equipment unlodged, often times it requires that the logging equipment be moved laterally away off from the shelf. This, can be accomplished by simply opening the particular gate in question, and providing thrust so that the thrust moves the equipment away from the wall wherein the shelf is protruding, and hopefully further down the hole.

Also in addition to providing the thrust and direction, the impeller 110 also serves to maintain the mud or fluid within the hole churned or turbulated so that it does not tend to congeal around the apparatus as it is lowered down. This problem of mud or the fluid congealing within the hole is also addressed by several other aspects of the apparatus.

The next particular section would be the electric transducer section 160. This particular section, the components of which were outlined earlier, actually is an ultrasonic energy emitting section wherein electrical power from interior electric line 28 is delivered to a ceramic or the like transducent 200 which emits ultra sound into the surrounding area via a plurality of vertically inclined slots 191 through 196 around the wall of the transducer section 160. Like the impeller which helps prevent congealing through the circulation of fluid or surrounding mud through the impeller section, the transducer section 160 addresses the problem of congealing or settling on the molecular level, i.e. transmitting out into the hole ultrasonic energy which helps to maintain the individual molecules of downhole fluid and mud separate and apart from one another as opposed to combining into multi molecular formations and eventually into lumps or the like. As seen in the drawing, the ultrasonic waves are provided access to the surrounding hole via the 6 vertically inclined slots 191 through 196 during the operation of this particular section. This section is not monitored by the micro processor and helps to prevent coagulation on the formation of molecular level.

The lower most mechanical operating unit is the mechanical vibration coil assembly 232. As was explained earlier, there is provided a solenoid 238 surrounding an internal shaft which is biased on its top portion by spring 244 and is allowed upward and downward movement against the bias of spring 244. In the operation, the activation of the solenoid 238 would pull shaft 250 upward until the shaft shoulder portion 252 would engage the lower most end of mounting collar 190, and in between cycles of activation, the spring 244 would bias shaft 250 back down into the lower position. This cyclical movement of the shaft upward and downward at a rate of 60 cycles per minute would serve as a vibrator in the apparatus. The lower most portion of shaft 250, as was stated earlier, is connected onto sub 280 which likewise would impart vibration to this particular sub 280. Therefore, the vibration would create a continuous vibration along the entire coil assembly which would again, affect or reduce the formation of large coagulants downhole as the apparatus moves down. Thus, while the transducer addresses to problem of congealing on a molecular level, the vibration coil assembly seeks to prevent congealing of larger units which tend to clog the ports of the apparatus and causing lodging downhole.

Despite the several means in apparatus 10 for steering and propelling of the apparatus in avoiding obstacles downhole, or helping to dislodge the apparatus from congealing drilling fluids or the like downhole, there is a possibility that the apparatus may become lodged to a degree that its several means for manipulating it and the surrounding fluids, become useless in dislodging it. Also, an effort to "pull it" out of the hole via the wire line is risky in that the wire line may snap, and the tool continues to be lodged downhole, with the only option being to send a "fishing tool" downhole in an effort to retrieve it.

Therefore, in further operation of the apparatus, as was described earlier, the utilization of explosive sub 320 on both the top and the bottom of the apparatus, may be necessary. As explosive sub 320 was described, there is a pair of chambers 340 and 342 housing explosive means 354 and 456 respectively. Explosive means 354 and 356 would further comprise detinator caps 358 and 359 which would be electrically connected to continuous electric line 28. In the event all other efforts to remove the apparatus fail, the microprocessor would be given the order to transmit electrical power to the detinators for detonating explosive charges 360 or 362, depending on how the micro-processor has sensed that the sub is lodged. For example, if the apparatus is lodged upon a certain well hole, below a "shelf" on a hole, it may be beneficial to detonate the upper explosive sub 320, and only that charge nearest the wall of the hole so that the apparatus would be thrusted downwardly and away from the wall, hopefully freeing it from the upper shelf. Likewise, should the apparatus be lodged in any other position, the micro-processor after having sensed the position of the apparatus in the hole, and the obstruction, a decision could be made to explode whatever explosive charges are necessary to dislodge the apparatus, and hopefully the logging equipment attached thereto.

Figure 11:
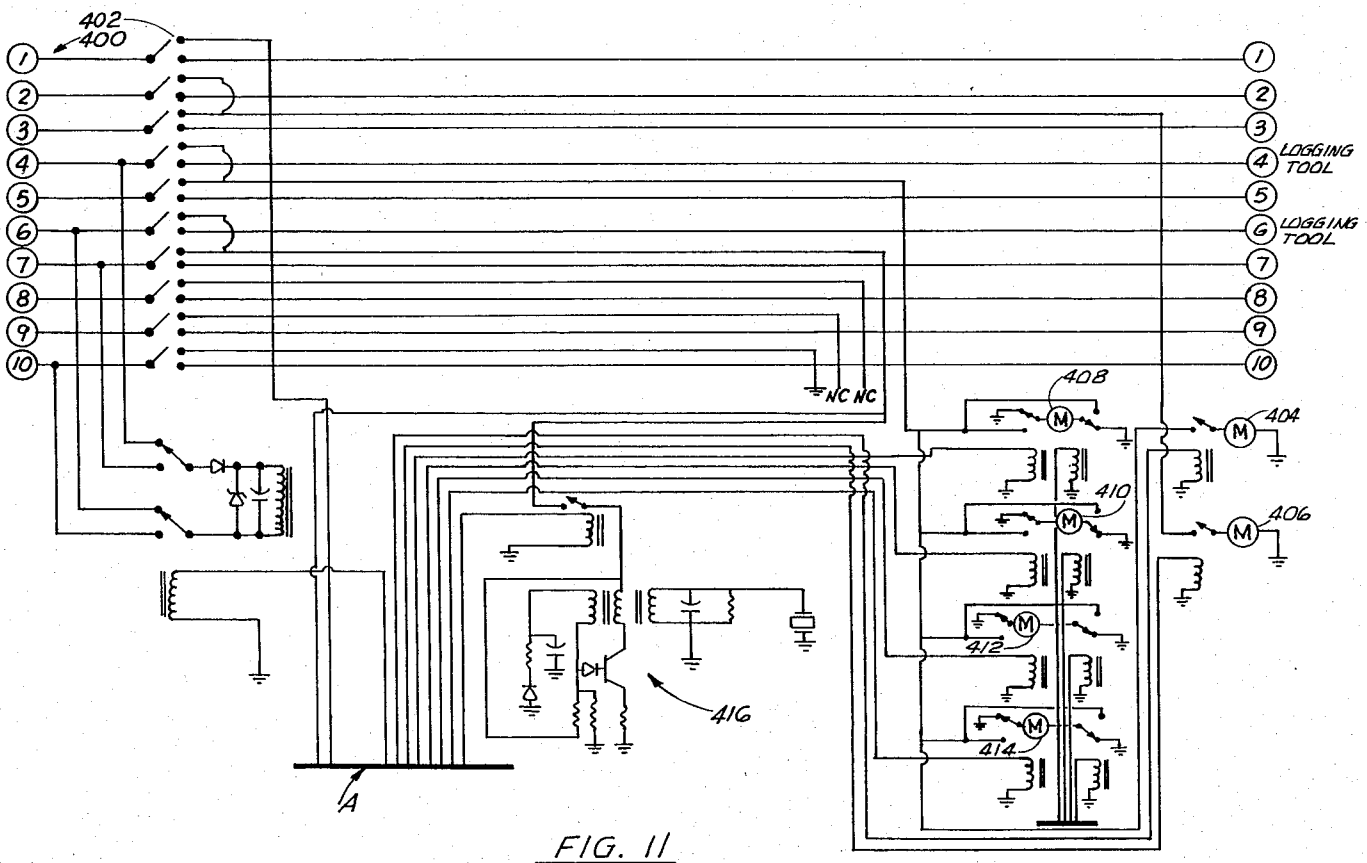
FIGS. 11 and 12 illustrate the electrical circuitry involved in the electronic assembly and micro processing unit in the preferred embodiment of the apparatus of the present invention.

Reference is now made to FIGS. 11 and 12 which illustrate the electrical circuitry contained in the electronic assembly microprocessor section 50 of apparatus 10. Actually, FIG. 12 is a continuation of FIG. 11, with the Figures being joined at point A on FIGS. 11 and 12. Turning now to FIG. 11, there is illustrated electrical input lines 400, (numbered 1 through 10 in the Figure) which indicate the individual circuits for voltage input into the tool from the drill floor when the tool is in operation. Further, each particular circuit has a switch 402 which is movable between open and closed positions for supplying power to or cutting off power from particular components of the tool to be energized. In FIG. 11, relay switches 402 are in the open position. It should be understood that in view of the fact that apparatus 10 is a mobility and propulsion tool to intermediate and a logging apparatus which would do the actual logging downhole. Therefore, several of circuits 4 and 6 as seen in FIG. 11) 400 shall be directed and by-pass apparatus 10 and feed directly into the logging tool on the lowermost end of apparatus 10, therefore upon activation of that particular circuit, the logging equipment would be activated, and no function of the tool would energize.

As seen in FIG. 11, circuit 2 would energize main thrust drive motor 152 for imparting rotation to impeller 124 in the apparatus. Circuit 5 activates the plurality of drive motor 64 through 68 for maneuvering gates 104 allowing flow through the tool and mechanical vibration coil assembly 232 of the apparatus. These reversible motors are indicated on FIG. 11 by numerals 408, 410, 412, and 414, respectively, and the circuits involved. Circuit numbered 7 on FIG. 11 supplies energy to sonic transducer section 416 as illustrated in FIG. 11.

Circuit switch 1, as numbered on FIG. 11, supplies electrical energy to computer 422 for powering the computer to direct the motors involved in the actual mechanical operation of the apparatus. With the inclusion of computer 422 in the apparatus, the computer as the ability to control the motors involved. The accelerameter, which is a standard acceleramoter which may be manufactured by Sistron Donner. With the inclusion of the acceleramoter section 540 and a magnetometer 424, the apparatus will have the ability to have a continuous directional survey downhole. Limit switches 426 determines when your gates 124 should be opened or closed when the readouts as supplied by computer 422.

The internal workings of the apparatus are directed by computer 422. The random access memory 432 enables internal processing to receive any kind of signal inducing processes on the continuous directional survey or storage for the stack in general routine for the central processing unit 430. Read only memory 434 would control the actual mechanical aspects of the apparatus and would contain the algorithms which actually enable computer 422 to operate the tool correctly. There is an additional output port 436 which controls multi-plexer 438 which multi-plexis data in for utilization. It should be noted that motors 408, 410, 412 and 414 in FIG. 22 connect to output post 436 (FIG. 12) for feeding into CPU 430.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An apparatus for steering equipment downhole, comprising:

a. a tool body;

b. steering means, including gate means on said tool body moveable between upward and downward positions for allowing fluid flow through a portion of said tool body;

c. impeller means rotatably mounted within said tool body for directing said fluid flow through said gate means on said tool body;

d. first means for imparting rotation to said impeller means; and e. second means for moving said gate means between said upward and downward positions.

2. The apparatus in claim 1, further comprising electric transducer means contained within said tool for providing electrosonic vibrations into the surrounding medium exterior of said tool body.

3. The apparatus in claim 1, further comprising vibrator means contained within said tool body for turbulating the medium exterior to said tool body.

4. The apparatus in claim 1, wherein said tool body is connected on its first end to an electric wire line and on its second end to logging means.

5. The apparatus in claim 1, wherein said gate means further comprises a plurality of at least four gates which are slidably moveable upward and downward for allowing flow of fluid therethrough, said gates moveable with the use of motor assemblies.

6. The apparatus in claim 1, further comprising electronic microprocessor means for directing the functions of said tool.

7. A downhole mobility and propulsion apparatus, comprising:

a. a cylindrical tool body, attachable at its first end to a wire line and at its second end to the tool to be propelled down hole;

b. a plurality of gate members positioned around the wall of said tool body, said gate members motor driven between opened and closed positions wherein in the closed position fluid flow is disallowed through said tool body, and in the open position fluid flow is allowed through said tool body;

c. a plurality of ports in the wall of said tool body and below said gate members, said ports allowing fluid flow within said tool body between said ports and said gate members when said gate members are in said open position;

d. impeller means in said tool body intermediate said gate member and said ports for directing of said fluid flow;

e. electric transducer means contained within a second portion of said tool body for providing electrosonic vibrations into the surrounding medium exterior of said tool body; and f. electric microprocessor means, contained within a third portion of said tool body for evaluating and directing information to the various working components within said tool body.

8. The apparatus in claim 7 further comprising mechanical vibrator means contained within said tool body imparting movement of at least a portion of said tool body between thirty and sixty cycles per minute for turbulating the medium surrounding the exterior of said tool body.

9. The apparatus in claim 7 wherein said impeller means impels fluid flowing through said tool body between said ports and said gates for imparting vertical or lateral movement to said tool body while downhole.

10. An apparatus for steering and propelling tools downhole, comprising:

a. a cylindrical tool body, attachable at its first end to a wireline and at its second end to the tool to be steered and propelled;

b. means contained within said tool body for directing fluid flow through said tool body and propelling said apparatus laterally and vertically downhole;

c. electrical transducer means contained within a portion of said tool body for providing ultrasonic waves exterior to said tool body, said transducer means further comprising a plurality of slots within the wall of said tool body for allowing greater access of said ultrasonic waves from said transducer means to the surrounding medium;

d. mechanical vibrator means contained within said tool body imparting movement of at least a portion of said tool body between thirty and sixty cycles per minute for turbulating the medium surrounding the exterior of said tool body; and e. explosive means, contained in a portion of said tool body, for retrofiring explosives exterior said tool for jarringly moving said tool body in a predetermined direction downhole.

11. A downhole steering and propelling tool, comprising:

a. a tool body;

b. steering and propelling means mounted within said tool body, comprising;

i. a plurality of gate members around the wall of said tool body, said gate members driven between opened and closed positions wherein in the closed position fluid flow is disallowed through said tool body, and in the open position fluid flow is allowed through said tool body;

ii. a plurality of ports in the wall of said tool body, below said gate members, said ports allowing fluid flow within said tool body between said ports and said gate members when said gate members are in said open position;

iii. an impeller in said tool body intermediate said gate members and said ports for directing fluid flow between said ports and said gate members when at least one of said gate members is in the open position and said impeller is rotated; and iv. means for selectively opening or closing one or all of said gate members for effecting lateral movement of said tool body as desired;

c. vibrator means mounted within said tool body comprising a mechanical vibrator imparting movement of at least a portion of said tool body for turbulating the medium surrounding at least a portion of the exterior of said tool body;

d. explosive means, mounted at either end of said tool body, said explosive means further comprising;

i. a sub member;

ii. at least a pair of explosive charges housed within said sub members;

iii. thrusting ports in the wall of said sub member providing access to the exterior of said explosive charges wherein upon charging, retrofire is emitted from at least one of said ports, thrusting said apparatus in the direction generally opposite said thrusting port;

e. electric transducer means contained within a portion of said tool body for providing ultrasonic waves exterior to said tool body, said transducer means further comprising a plurality of slots within the wall of said tool body for allowing greater access of said ultrasonic waves from said transducer means to the surrounding medium; and f. electric microprocessor means contained within an additional portion of said tool body for directing information to the various working components within said tool body.

* * * * *